US007263881B2

(12) United States Patent
Ramakrishnan

(10) Patent No.: US 7,263,881 B2
(45) Date of Patent: Sep. 4, 2007

(54) SINGLE PROBE DOWNHOLE SAMPLING APPARATUS AND METHOD

(75) Inventor: Terizhandur S. Ramakrishnan, Bethel, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 127 days.

(21) Appl. No.: 11/007,412

(22) Filed: Dec. 8, 2004

(65) Prior Publication Data

US 2006/0117842 A1 Jun. 8, 2006

(51) Int. Cl.
*E21B 47/08* (2006.01)

(52) U.S. Cl. ..... 73/152.55

(58) Field of Classification Search ..... 73/152.55, 73/152.18

See application file for complete search history.

(56) References Cited

U.S. PATENT DOCUMENTS

| | | | | |
|---|---|---|---|---|
| 6,301,959 | B1 | 10/2001 | Hrametz et al. | 73/152.23 |
| 2005/0133261 | A1 | 6/2005 | Ramakrishnan et al. | 175/40 |
| 2006/0076132 | A1* | 4/2006 | Nold et al. | 166/264 |

FOREIGN PATENT DOCUMENTS

GB 2 390 105 A 12/2003

OTHER PUBLICATIONS

Mullins, O.C. et al. *Downhole Determination of Gor on Single-Phase Fluids by Optical Spectroscopy. SPWLA 42nd Annual Logging Symposium*, Houston, TX (Jun. 17-20, 2001).

Ramakrishnan, T. S. et al. *A Laboratory Investigation of Permeability in Hemispherical Flow with Application to Formation Testers. SPE Form. Eval.* 10:99-108 (Jun. 1995).

Weber, H. *Ueber die besselschen functionen und ihre anwendung auf die theorie der elektrischen strome. Journal fur. Math.*, 75: 75-105, (1965).

Wilkinson et al. *A Perturbation Method for Mixed Boundary-Value Problems in Pressure Transient Testing. Transport in Porous Media* 5: 609-636 (1990).

* cited by examiner

*Primary Examiner*—Hezron Williams
*Assistant Examiner*—Rodney Frank
(74) *Attorney, Agent, or Firm*—David P. Gordon; Vincent P. Loccisano; Jody Lynn DeStefanis

(57) ABSTRACT

A single probe system is utilized to quickly obtain uncontaminated formation fluid samples. The single probe includes an outer guard tube and an inner sampling tube which is slightly recessed relative to the outer tube such that the pressure at the front face of the probe is substantially uniform. Each tube is coupled to its own pump which controls the flow rate of the fluid moving through that tube. Knowing the size of the sampling tube relative to the size of the outer probe tube, and optionally based on relative viscosities of formation fluids and filtrates, the pumps are caused to generate a particular flow rate ratio through the tubes such that an appropriate pressure is maintained at the front face of the probe and such that the fluid flowing through the sampling tube is substantially uncontaminated.

38 Claims, 5 Drawing Sheets

SINGLE PROBE DOWNHOLE SAMPLING APPARATUS AND METHOD

BACKGROUND OF THE INVENTION

1. Field of the Invention

This invention relates broadly to formation fluid collection. More particularly, this invention relates to a single probe formation tester that permits a relatively quick recovery of formation fluids without contamination caused by borehole fluids.

2. State of the Art

During drilling of a wellbore, a drilling fluid ("mud") is used to facilitate the drilling process. In order to avoid a blowout of the well, the drilling mud is maintained at a pressure in the wellbore greater than the fluid pressure in the formations surrounding the wellbore. In many instances, the drilling mud is often an oil-based mud ("OBM"). Because of the pressure difference between the wellbore mud and the formations, the drilling fluid penetrates into or invades the formations for varying radial depths (referred to generally as invaded zones) depending upon the types of formation and drilling fluid used. The OBM miscibly mixes with the crude oil, thus making separation of crude oil from any collected samples difficult.

When samples of native fluids are desired after drilling, formation testing tools are used to retrieve the formation fluids from the desired formations or zones of interest. Much time is spent trying to obtain native formation fluids substantially free of mud filtrates, and collect such fluids in one or more chambers associated with the tool. The collected fluids are sometimes optically and/or electrically analyzed downhole, but are also often brought to the surface and analyzed to determine properties of such fluids and to determine the condition of the zones or formations from where such fluids have been collected.

Formation fluid testers utilize fluid sampling probes. The testers typically include a pad that is mechanically pressed against the formation to form a hydraulic seal, and a metal tube or probe which extends through the pad in order to make contact with the formation. The tube is connected to a sample chamber, and a pump is used to lower the pressure at the probe below the pressure of the formation fluids in order to draw the formation fluids through the probe. In some prior art devices, an optical sensor system is utilized to determine when the fluid from the probe consists substantially of formation fluids. Thus, initially, the fluid drawn through the probe is discarded. When the fluid samples prove to be uncontaminated from the OBM, the fluid samples are diverted to the sample chamber so that they can be retrieved and analyzed when the sampling device is recovered from the borehole. However, it has been found that it can take an inordinate of time (e.g., many hours) for an uncontaminated fluid sample to be obtained.

In order to reduce the time is takes to obtain an uncontaminated fluid sample, U.S. Pat. No. 6,301,959 to Garnder et al. proposes the use of a probe system including a hydraulic guard ring probe surrounding an inner probe, with a seal therebetween, and an outer seal between the guard region and the formation. The guard ring is used to isolate the inner probe from the contaminating borehole fluid. The guard ring is provided with its own flow line and sample chamber, separate from the flow line and the sample chamber of the probe tube. By maintaining the pressure in the guard ring probe at or slightly below the pressure in the inner probe tube, according to Garnder et al., most of the fluid drawn into the inner probe tube after a reasonable time will be connate formation fluid.

The Gardner et al. solution suffers from various drawbacks. For example, the use of two seals with the outer guard ring and the inner probe tube is a relatively complex arrangement. In fact, the arrangement with two seals is prone to failure, since, as admitted by Garnder et al., the seals often do not function as intended. In addition, the arrangement of the Garnder et al. invention requires careful control of pressure in the guard and sample lines so as to obtain the full "guard effect".

SUMMARY OF THE INVENTION

It is therefore an object of the invention to provide a downhole fluid sampling system which is adapted to relatively quickly obtain uncontaminated fluid samples.

It is another object of the invention to provide a downhole fluid sampling system which utilizes a single probe but is able to relatively quickly obtain substantially uncontaminated formation fluid samples.

It is a further object of the invention to provide methods of relatively quickly obtaining uncontaminated formation fluid samples utilizing a single probe.

In accord with these objects, which will be discussed in detail below, a single probe system is utilized to relatively quickly obtain uncontaminated formation fluid samples. The single probe includes an outer probe tube and an inner sampling tube which is slightly recessed relative to the outer tube such that the pressure at the front face of the probe is substantially uniform. Each tube is coupled to its own pump which controls the flow rate of the fluid moving through that tube. Knowing the size of the sampling tube relative to the size of the outer probe tube, the pumps are caused to generate a particular flow rate ratio through the tubes. By maintaining a uniform pressure at the front face of the probe, the flow rate ratio is such that after a relatively short period of time the fluid flowing through the sampling tube is substantially uncontaminated.

According to one preferred aspect of the invention, both the outer and inner tubes include sharp edges; the outer tube sharp edge for extending through the mudcake into contact with the formation, and the inner tube sharp edge for precisely defining its radial position within the probe. According to another preferred aspect of the invention, the front of the inner sampling probe is located between 1 mm and 5 mm behind the front of the outer tube.

According to the methods of the invention, the desired flow rate ratio is determined in different manners based on the assumptions which govern the system. In a first embodiment, a homogeneous system is assumed (i.e., the formation is locally isotropic), and the flow rates through the sampling tube $Q_s$ and the outer "guard" tube $Q_g$ generated by the pumps are dictated by relatively simple functions or equations:

$$Q_p = Q_s + Q_g \text{ and } \frac{Q_s}{Q_p} = 1 - \frac{1}{r_p}\sqrt{r_p^2 - r_s^2}$$

where $Q_p$ is the total flow rate through the probe, and $r_p$ and $r_s$ are respectively the radius of the entire probe and the radius of the inner sampling tube.

In a second embodiment of the method of the invention, a non-homogeneous system is assumed where the viscosity distribution of the fluid in the formation is assumed non-uniform (i.e., the viscosity of the OBM filtrate and the formation fluids differ significantly). With the non-homogeneous system, according to a first approach, a non-iterative technique is used with an assumption that the sharp edge of the inner tube is located at the fluid front (i.e., at the location of viscosity change). In this embodiment, more complex equations which are a function of both the radii values and the viscosities of the fluids are utilized to set the flow rates through the sampling tube and the outer guard tube.

According to a second approach, an iterative solution is utilized which assumes a front location, but then uses an iterative computation to estimate the front location. In the iterative solution, in addition to the radii values and viscosities of the fluids, it is necessary to determine the fractions of the oil and filtrate volumes in the sampling line in order to set the appropriate flow rates. With the iterative solution, the location of the front and the flow rates $Q_s$ and $Q_g$ will be recomputed several times until convergence. Such computations are carried out in real time for each of the sampling data acquisition points.

According to a third approach which accounts for a non-homogeneous system, a data based corrective sampling technique is used where a value for the front location is assumed, samples are taken at desired rates based on the assumed front location, and then based on known or determined viscosities, known probe radii, and a determined volume fraction of formation fluid in the sampling tube, an estimate of the front location is calculated. This process is repeated several times for several different assumed front location values, and interpolation is utilized to find an assumed front location value which will equal the calculated value. Then, using the interpolated value, the flow rate for the sampling tube is recalculated and utilized.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
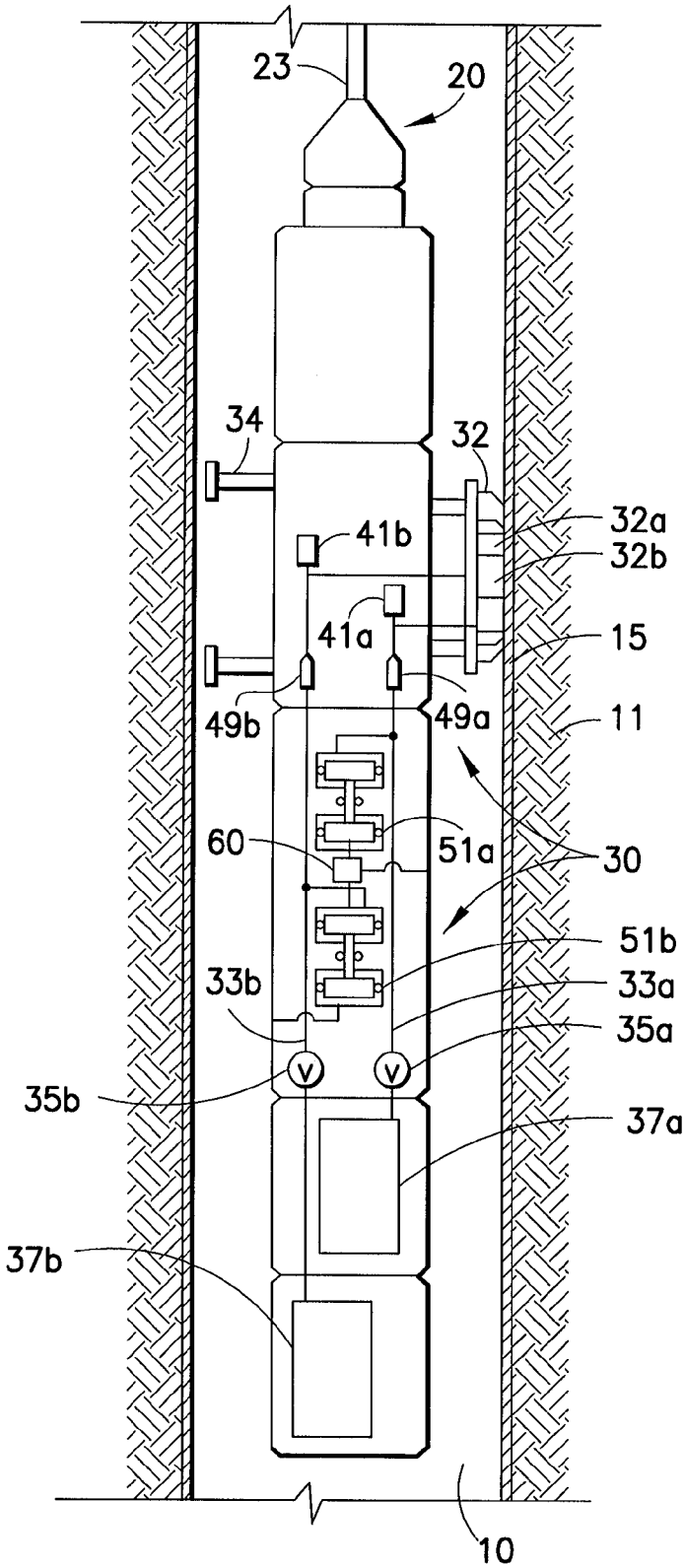
FIG. 1 is a schematic illustration of an embodiment of the invention.

Turning now to FIG. 1, a borehole 10 is seen traversing a subterranean formation 11. The borehole wall is covered by a mudcake 15. A formation tester tool 20 is seen connected to a wireline 23 which extends from a rig at the surface (not shown). Alternatively, the formation tester tool 20 may be carried on a drillstring.

Figure 2:
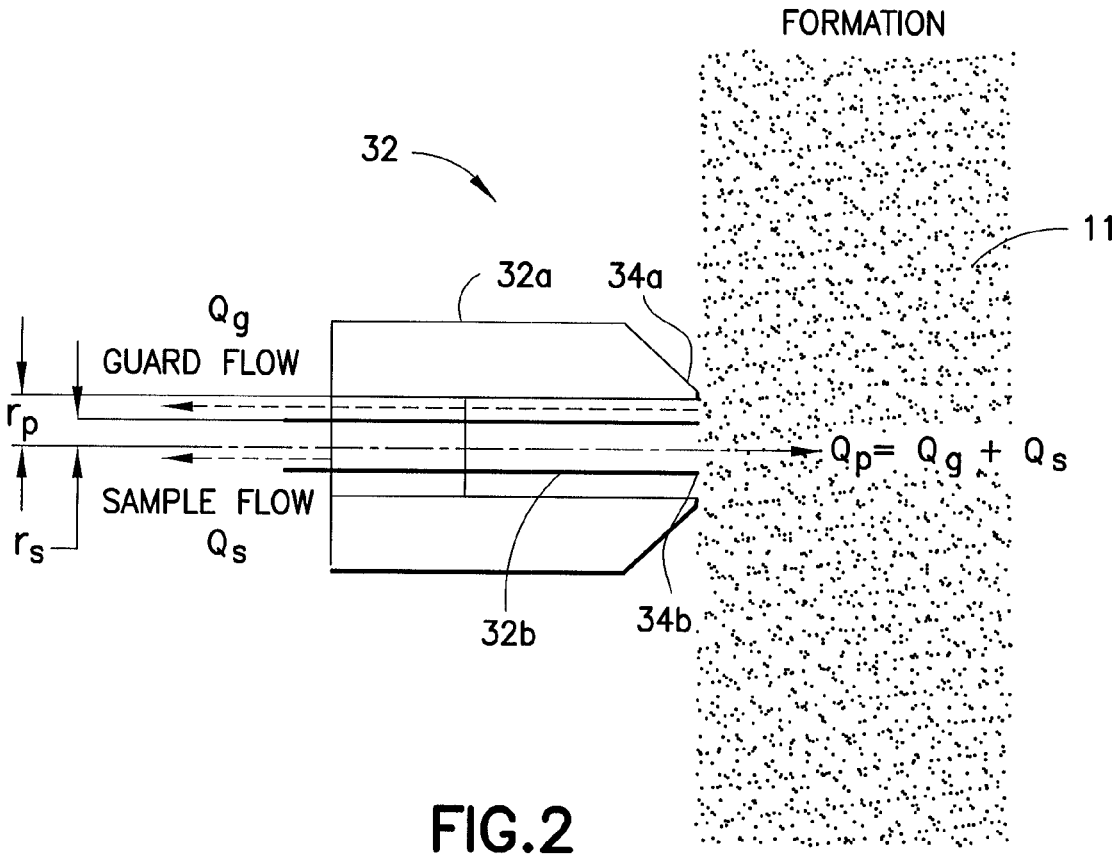
FIG. 2 is a cross-sectional diagram of the probe of the invention.

The formation tester tool 20 is provided with a fluid sampling assembly 30 including a probe 32 (shown in more detail in FIG. 2), and extendable arms 34 or other mechanisms which are used to mechanically push and fix the probe 32 into engagement with the borehole. As seen in FIG. 2, probe 32 includes an outer or guard tube 32*a* and an inner or sample tube 32*b*. Each tube is preferably provided with a sharp tip or knife edge, with the sharp tip 34*a* of the outer tube being slightly forward (preferably between 1 mm and 5 mm forward) the sharp tip 34*b* of the inner tube. The tubes 32*a*, 32*b* are respectively connected by hydraulic flow lines, 33*a*, 33*b*, via valves 35*a*, 35*b* to sample chambers, 37*a*, 37*b* (sample chamber 37*a* being optional).

As seen in FIG. 1, the hydraulic flow lines 33*a* and 33*b* are each optionally provided with flow-rate sensors 41*a* and 41*b* and with optical sensors (not shown). In addition, the flow lines 33*a* and 33*b* are provided with pumps 51*a* and 51*b*. As will be discussed in more detail hereinafter, these pumps are controlled by a controller 60 which causes the pumps to operate to pull fluid at desired flow rates. The pumps are optionally operated by piston movement, and the rate of the piston movement may be controlled. Further, according to certain embodiments of the invention, the flow lines are provided with sensors 49*a*, 49*b* which permit determinations of the viscosities of the fluids flowing through the lines, and the volume fractions of formation and filtrate fluids flowing through the lines. The sensors may include processors incorporated therewith. Alternatively, the sensors may provide information to a processor coupled to controller 60; or the controller may be adapted to process information. Details of the sensors and the processing which may be used to obtain viscosity information and volume fraction information may be had by reference to co-owned U.S. Ser. No. 10/741,078 entitled "Formation Fluid Characterization Using Flowline Viscosity and Density Data in an Oil Based Mud Environment", filed Dec. 19, 2003, which is hereby incorporated by reference herein in its entirety, and to various publications referenced therein. If desired, other apparatus and techniques for determination of viscosity and/or volume fraction information may be utilized.

As will be appreciated by those skilled in the art, the valves 35*a*, 35*b* are provided to restrict actual fluid flow into the sample chambers 37*a*, 37*b*. In particular, it may be desirable to discard initial samples as those samples may be contaminated. Thus, pumps 51*a* and 51*b* will discharge the unwanted samples. At some time (early relative to the time required in the prior art—e.g., at some time less than one hour) when the fluid samples being obtained are substantially uncontaminated, valve 35*b* is opened to allow the fluid in the probe flowline 33*b* to be collected in the probe sample chamber 37*b*. Similarly, by opening valve 35*a*, the fluid in the guard flowline 33*a* may be collected in the guard sample chamber 37*a*, when provided.

Turning back to FIG. 2 again, in the preferred embodiment of the invention, the sampling tube 32*b* is coaxial with the guard tube 32*a*. Because the sampling tube is recessed slightly relative to the guard tube, when the probe is pushed against the borehole wall, the sampling tube does not touch the wall itself. Thus, the pressure at the edge of the probe at both the sampling and guard locations is essentially the same; i.e., substantially uniform. For purposes herein, the term "substantially uniform" is to be understood to mean within 10%, although in accord with the preferred embodiment, due to the recessing of the sampling tube relative to the guard tube, the difference in pressure at the edge of the probe at both the sampling and guard locations is typically less than 1%.

As seen in FIG. 2, the sample tube and outer guard tube are each preferably provided with a knife-edge. The purpose for the knife-edge of the sample tube (as will be discussed in more detail below) is to reduce obstruction or alteration to fluid flow, to prevent boundary layer separation induced cross-flow from occurring, and to establish an unambiguous sampling tube radius $r_s$. The purpose of the outer tube knife-edge is to permit the probe to cut through the mudcake and make a sealing contact with the borehole wall.

As previously mentioned, according to the invention, in order to relatively quickly obtain an uncontaminated fluid sample through the sample tube, it is necessary for the pumps to establish desired flow rates through the tubes. The theoretical basis for generating appropriate flow rates is as follows.

The flux distribution into a probe is correctly known when the probe is placed on a flat surface. H. Weber. "Ueber die besselschen functionen und ihre anwendung auf die theorie der elektrischen strome" *Journal fur. Math.,* 75:75-105, 1873. In the borehole, since the probe radius $r_p$ is much smaller than the borehole radius $r_w$, i.e., $r_p \ll r_w$, the probe may be considered to be located on a flat surface. For a given pressure, a finite $r_w$ slightly enhances the flow into the probe (see D. J. Wilkinson and P. S. Hammond, "A perturbation method for mixed boundary-value problems in pressure transient testing", *Trans. Porous Media,* 1990) since the flow goes from hemispherical at short length scale greater than $r_p$ to spherical for large distances from the probe. Naturally, the zero'th order flux distribution is also only slightly altered.

It is also known that large-scale anisotropy is invariably a manifestation of heterogeneity. Limited laboratory experiments show that rocks may be isotropic at the probe length scale (see T. S. Ramakrishnan et al., "A laboratory investigation of hemispherical flow permeability with application to formation testers", *SPE Form. Eval.,* 10:99-108, 1995), although in the large scale they may be anisotropic. Therefore, it may be assumed that the formation is locally isotropic.

The flux distribution into the probe under the above assumptions is known from Weber's above-cited work. In particular $$q_P = \frac{Q_P}{2\pi r_p^2\sqrt{1-\frac{r^2}{r_p^2}}} \tag{1}$$

where $q_p$ is the probe flux and is a function of r which is the radial distance from the center of the probe to a location on the probe face, and $Q_p$ is the flow rate into the probe.

Given equation (1), it will be seen that the flow rate into the sampling tube central area of radius $r_s$ is defined by $$Q_S = \frac{Q_P}{2\pi r_p^2}\int_0^{r_s}\frac{2\pi r dr}{\sqrt{1-\frac{r^2}{r_p^2}}} \tag{2}$$

Thus, the ratio of the flow rates $Q_s$ and $Q_p$ is $$\frac{Q_s}{Q_p} = 1-\frac{1}{r_p}\sqrt{r_p^2-r_s^2} \tag{3}$$

This ratio is determined by the radius of the probe and the radius of the sampling tube only, both of which are known. By locating the face of the sampling tube just slightly behind the face of the guard tube, a transition to a parabolic profile of laminar flow is avoided and as a result cross-flow is prevented. Indeed, by causing the pumps to establish flow rates according to the ratio of equation (3), (it being appreciated that the flow rate into the guard tube $Q_g=Q_p-Q_s$), flow into respective areas of the probe is established. By avoiding cross-flow, after a relatively short period of time (e.g., often within an hour), the flow into the sample tube will be substantially uncontaminated native fluid.

Using equation (3) as a basis, the sampling tube and the outer guard tube can be specifically proportioned so that the flow rates through them will be desirably set. For example, if it desired that the pumps establish identical flow rates through the tubes (i.e., $Q_s=(1/2)Q_p$), then, from equation (3), the radius of the sampling tube $r_s$ is set to $$r_s = \frac{\sqrt{3}}{2}r_p. \tag{4}$$

In other words, in order to have half the flux occur through the annulus of the sampling tube and the other half through the outer guard tube, the radius of the sampling tube should be designed to be approximately 0.866 the radius of the probe. Similarly, if it is desired for one-quarter of the total flow to flow through the sampling tube, according to equation (3), $$r_s=0.661r_p \tag{5}$$

In other words, to have one-quarter of the flux occur through the annulus of the sampling tube and the other three-quarters through the outer guard tube, the radius of the sampling tube should be designed to be approximately ⅔ the radius of the probe.

By imposing flow rates at the proper ratio, uniform pressure is maintained at the probe, cross-flow between the guard and sampling sections of the probe is avoided, and the difficult design of a pressure control system (required by the prior art) is avoided as fixed rate pumping is utilized instead. Furthermore, uniformity of pressure is automatically maintained without the need for a complicated pressure control system.

Figure 4B:
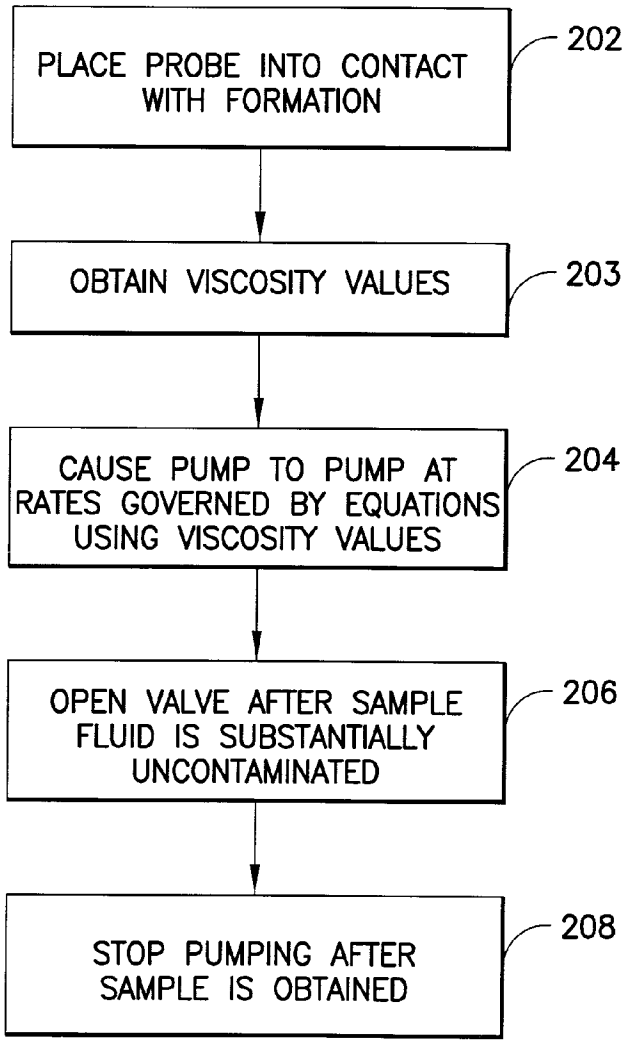
FIGS. 4*a*-4*d* are flow charts of methods according to first, second, third and fourth method embodiments of the invention.
Figure 4A:
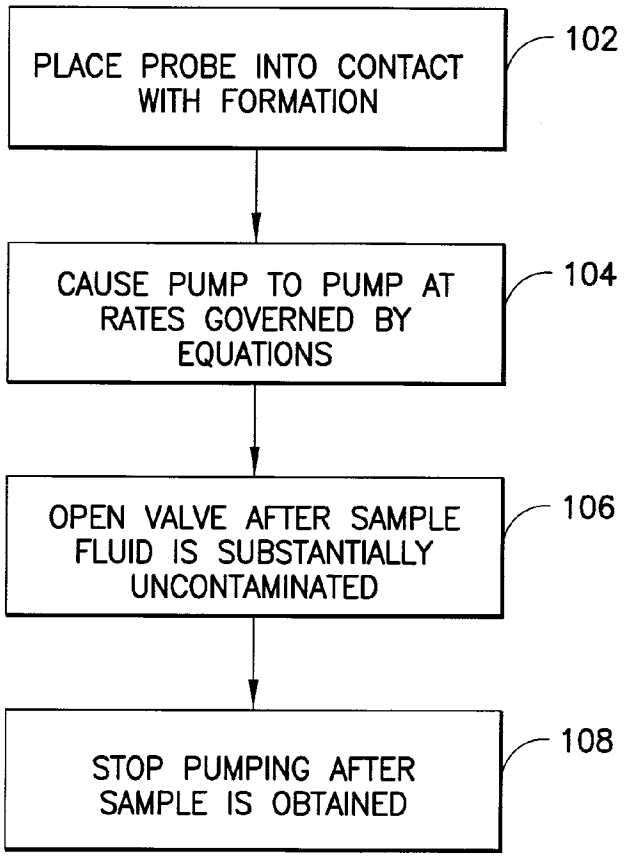

Given the above, according to the invention, a first method for obtaining fluid samples from a formation assumes a homogeneous system and includes the steps of FIG. 4*a*. Thus, at 102, a probe having a sampling tube of a first known radius and a guard tube of a second known radius is placed into contact with the formation, with the sampling tube recessed slightly relative to the guard tube. At 104, pumps coupled to the sampling tube and the guard tube are caused to pump at rates governed by the equations $$\frac{Q_s}{Q_p} = 1-\frac{1}{r_p}\sqrt{r_p^2-r_s^2}$$

and $Q_g=Q_p-Q_s$. At 106, some time after the pumping starts, when it is determined through optical or other means that the flow through the sampling tube is substantially uncontaminated by filtrate, a valve is opened which causes a sample from the sampling tube to go to a sampling chamber. When a desired sample is obtained, at 108 the pumping stops. The tool may then, be moved to a new location, and steps 102 through 108 repeated to obtain another sample. This procedure may be repeated as many times as desired until all sample chambers are filled, or until it is desired to retrieve the samples.

While the theoretical basis of the invention to this point has assumed a substantially homogeneous system, according to another aspect of the invention, the pumping rates may be controlled in a manner which accounts for inhomogeneity. In particular, when considering the case of the mingling of crude oil and an OBM filtrate, it will be appreciated that the viscosity of the mixture is not linearly related to the volumetric fractions of the respective fluids. Nevertheless, for reasonable viscosity ratios, the relationship is well behaved; i.e., the viscosity of the mixture is monotonic from one fluid to another. It should be noted that the viscosities can be measured or determined as set forth in previously incorporated co-owned U.S. Ser. No. 10/741,078.

For most practical situations, the differences in viscosity between the OBM and the crude oil will not be large (i.e., they will typically be less than a factor of 10 apart, and often within a factor of two apart unless heavy oil is involved). As the viscosities approach each other, equations (1)-(3) hold. However, when the viscosities in the two lines are different, equation (1) is no longer exact. While an exact solution is extraordinarily difficult to construct, an approximation which assumes that the front position between the formation and filtrate fluids is stationary can be utilized to account for different viscosities without solving detailed boundary value problems.

More particularly, after a small time period in the sampling process, the changes in the distribution of properties will be slow. Thus, while the velocity of fluid into the probe may be rapid, the front position will be changing slowly; i.e., the velocity normal to the front will be much smaller than the tangential velocity. It may therefore be taken for granted that after a short period of time, the front position is stationary and that the normal velocity at the front is nearly zero.

Figure 3:
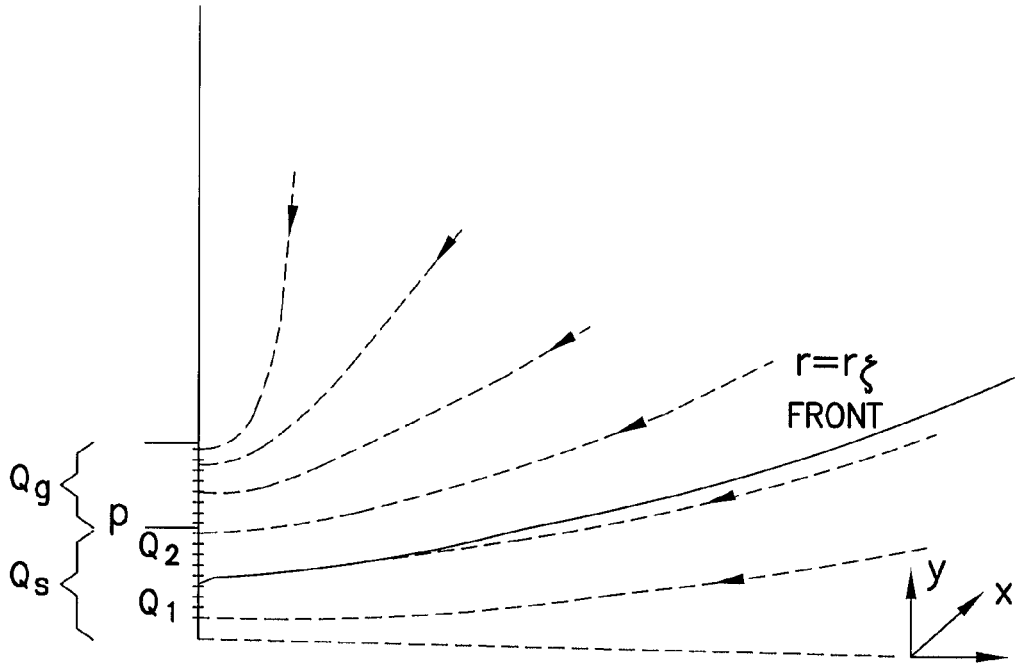
FIG. 3 is an illustration of flow lines and a front between contaminated and non-contaminated fluids.

The example of FIG. 3 is a useful illustration of the issues relating to the front. In FIG. 3, fluid from the front is shown as being received at position vector $\underline{r}=\underline{r}_\zeta$ of the probe, with fluid below the front line (zone 1) representing formation fluids, and fluid above the front line (zone 2) representing filtrate. The position of the sampling tube is shown within radius $r_s$, and the position of the guard tube is between radius $r_s$ and radius $r_p$. With the position of the sample tube and the front as shown, the sample tube should see a mixture of the formation fluid and the filtrate, while the guard tube should see filtrate only. In reality, each stream might consist of a mixture of the formation oil and filtrate in which the fraction of each component is expected to change. In the absence of diffusion (or viscous fingering), after a short period of time, one may expect to see the mixture of fluids in the sampling tube to transition to formation oil only. Prior to the transition, the guard tube would see only filtrate.

Where the viscosities of the two fluids are sufficiently far apart (e.g., 10%) that contamination causes a relevant change in the mixture viscosity and the flux distribution at the probe is altered from equation (1), it becomes desirable to account for viscosity in designing a system which will not have cross-flow. Two techniques (a non-iterative approach and an iterative approach) are set forth hereinafter do this. In both techniques it is desirable to have a substantially real-time measurement or determination of viscosity (such as set forth in previously incorporated U.S. Ser. No. 10/741,078).

In the non-iterative technique, an interface (front) is assumed whose position vector is $\underline{r}_\zeta$ positioned such that at the borehole wall (z=0) the radial position of $\underline{r}_\zeta$ is $r_s$, but with the effective viscosities as observed in the flow lines; i.e., $\mu_s$ in region 1 and μg in region 2. In other words, a viscosity of $\mu_s$ is assigned for $\mu_1$ which corresponds to the viscosity of the fluid in the formation for all streamlines entering the probe at a radius of $r<r_s$, and $\mu_g$ is assigned for $\mu_2$ for fluid entering the probe at $r>r_s$, where r=0 at the center of the probe.

Using the above assumptions, the governing equations are $$\nabla^2 p_1=0 \tag{6a}$$

$$\nabla^2 p_2=0 \tag{6b}$$

where $p_1$ and $p_2$ are the pressures in zones 1 and 2 respectively. The boundary conditions are that at the interface $\underline{r}=\underline{r}_\zeta$ $$p_1=p_2, \forall \underline{r}=\underline{r}_\zeta \tag{7}$$

$$\lambda_1 \frac{\partial p_1}{\partial n_\zeta} = \lambda_2 \frac{\partial p_2}{\partial n_\zeta} \quad \forall \underline{r} = \underline{r}_\zeta \tag{8}$$

where $n_\zeta$ is the unit normal, and where λ is the fluid mobility.

It will be appreciated by those skilled in the art that as $$|\underline{r}|$$

approaches infinity, the pressure goes to zero. At the probe, if the front location is termed $r_\zeta$, then $$-\lambda_1 \int_0^{r_\zeta} \frac{\partial p_1}{\partial z} 2\pi r dr = Q_1, \quad z=0 \tag{9a}$$

$$-\lambda_2 \int_{r_\zeta}^{r_p} \frac{\partial p_2}{\partial z} 2\pi r dr = Q_2, \quad z=0 \tag{9b}$$

with the total flow rate into the probe $Q_p=Q_1+Q_2$. The mixed boundary value at z=0 means that $$p_p = p_s = p_g = p_1 = p_2, \forall r < r_p, z=0 \text{ and} \tag{10}$$

$$\frac{\partial p_2}{\partial z} = 0, \forall r > r_p, z=0 \tag{11}$$

Fixing $p_p$ determines $Q_p$, $Q_1$ and $Q_2$. Conversely, fixing $Q_p$ determines $p_p$, $Q_1$ and $Q_2$.

To get an approximate answer as to how to eliminate cross-flow in the probe, the homogeneous problem can be considered where $\mu_s=\mu_1=\mu_2$. The flux distribution for this case is the same as equation (1) and the solution is denoted $p_h(r,z)$ where the subscript "h" indicates "homogeneous". This solution clearly satisfies Laplace's equation everywhere, and has no flow for $r>r_p$. Furthermore, the pressures are equal on either side of the front curve $\underline{r}=\underline{r}_\zeta$. A correction term can now be found to $p_h(r,z)$ for the specific assumption of the two fictitious fluids with the interface positioned at $r_s$ when z=0. For this specific case, the subscripts 1 and 2 are replaced by s (denoting "sample") and g (denoting "guard").

Let $$p_s = p_h + p_{cs} \tag{12a}$$

$$p_g = p_h + p_{cg} \tag{12b}$$

where $p_{cs}$ and $p_{cg}$ are respective pressure correction terms for the sample and guard. The correction pressures $p_{cs}$ and $p_{cg}$ are clearly equal at $r_\zeta$, and should go to zero when r approaches infinity. They satisfy the condition that their value is zero and their derivative with respect to z is zero when $r>r_p$. The normal derivative at the boundary $r_\zeta$ should obey $$\lambda_s \frac{\partial p_{cs}}{\partial n_\zeta} - \lambda_g \frac{\partial p_{cg}}{\partial n_\zeta} = \lambda_g \frac{\partial p_h}{\partial n_\zeta} - \lambda_s \frac{\partial p_h}{\partial n_\zeta}, \quad \underset{\sim}{r} = \underset{\sim}{r}_\zeta \tag{13}$$

At the probe face, the total flow rate $Q_p$ is the sum of $Q_s$ and $Q_g$ which are defined by $$-\frac{k}{\mu_s}\int_0^{r_s} \frac{\partial \bar{p}_{cs}}{\partial z} 2\pi r\, dr = Q_s - Q_{hs}, \quad z = 0 \tag{14a}$$

$$-\frac{k}{\mu_g}\int_{r_s}^{r_p} \frac{\partial \bar{p}_{cg}}{\partial z} 2\pi r\, dr = Q_g - \frac{\mu_s}{\mu_g} Q_{hg}, \quad z = 0 \tag{14b}$$

where now $$Q_{hs} = Q_{hp}\left[1 - \frac{1}{r_p}\sqrt{r_p^2 - r_s^2}\right] \tag{15}$$

and $$Q_{hg} - Q_{hp} - Q_{hs} \tag{16}$$

As previously indicated, $Q_p$ is dictated by the probe pressure. Total flow $Q_p$ is quite inconsequential to the analysis as it is actually the relative flow rates or ratio $Q_s/Q_g$ which are of interest and which are chosen to prevent cross-flow.

If an algorithm is constructed such that upon measuring the viscosities in the sampling tube and the guard tube ($\mu_s$,$\mu_g$), $Q_s$ and $Q_g$ are set so that $$Q_s = Q_{hs}, \tag{17a}$$

$$Q_g = (\mu_s/\mu_g) Q_{hg} \tag{17b}$$

then all boundary conditions become homogeneous except for small source terms as per equation (13); i.e., the right hand side of equation 13 is not exactly zero. If the front is slow moving, as previously stated, then we expect this to be a weak source, and therefore expect the correction terms to be small enough to be ignored. Thus, with eqatuions (17a) and (17b), the correction pressures satisfy homogeneous boundary conditions and become zero. As a result, combining equations (17a) and (17b) yields the ratio of interest:

$$\frac{Q_s}{Q_g} = \frac{Q_{hs}}{Q_{hg}} \frac{\mu_g}{\mu_s} \tag{18}$$

which automatically satisfies the condition of pressure uniformity at the probe face. Now, combining equations (3) and (18), it will be seen that $$\frac{Q_s}{Q_s + Q_g} = \frac{Q_s}{Q_p} = \frac{\left[1 - \frac{1}{r_p}\sqrt{r_p^2 - r_s^2}\right]}{\left[1 - \frac{1}{r_p}\sqrt{r_p^2 - r_s^2}\right] + \frac{\mu_s}{\mu_g}\frac{1}{r_p}\sqrt{r_p^2 - r_s^2}} \tag{19}$$

with $$Q_g = Q_p - Q_s. \tag{20}$$

Given equation (19), a second method for obtaining fluid samples from a formation assumes an inhomogeneous system and includes the steps of FIG. 4*b*. Thus, at 202, a probe having a sampling tube of a first known radius and a guard tube of a second known radius is placed into contact with the formation, with the sampling tube recessed slightly relative to the guard tube. At 203, the viscosities $\mu_s$ and $\mu_g$ are assumed, or measured or determined by the viscosity sensors 49*a*, 49*b*. At 204, based on the viscosity values, the pumps coupled to the sampling tube and the guard tube are caused to pump at rates governed by the equations $$\frac{Q_s}{Q_s + Q_g} = \frac{Q_s}{Q_p} = \frac{\left[1 - \frac{1}{r_p}\sqrt{r_p^2 - r_s^2}\right]}{\left[1 - \frac{1}{r_p}\sqrt{r_p^2 - r_s^2}\right] + \frac{\mu_s}{\mu_g}\frac{1}{r_p}\sqrt{r_p^2 - r_s^2}}$$

and $Q_g = Q_p - Q_s$. The total pumping rate $Q_p$ is chosen so that the probe pressure is above the bubble point, but preferably near the bubble point in order to establish a good flow. At 206, some time after the pumping starts (preferably within an hour), when it is determined through optical or other means that the fluid being pumped through the sampling tube is substantially uncontaminated, a valve is opened which causes a sample from the sampling tube to go to a sampling chamber. When a desired sample is obtained, at 208 the pumping stops. The tool may then be moved to a new location, and steps 202 through 208 repeated to obtain another sample. This procedure may be repeated as many times as desired until all sample chambers are filled, or until it is desired to retrieve the samples.

Turning now to the iterative approach for accounting for viscosity, the assumption of the interface (front) being located at $r_s$ may be relaxed so that the front is allowed to move slowly from r=0 to $r=r_s$ and then towards $r_p$. When the front crosses $r_s$ the fluid sample can be sent to the sampling chamber, so movement of the front past $r_s$ towards $r_p$ is effectively irrelevant although an extension of the following analysis applies.

According to the iterative approach, the oil and filtrate volume fractions $z_{s1}$ and $z_{s2}$ in the sampling line are known or calculated (as described in previously incorporated Ser. No. 10/741,078) and the viscosities of the fluids are likewise known, measured or calculated as previously described.

It may be assumed to start that the viscosity of the formation oil is less than the viscosity of the OBM filtrate. It may also be assumed that $r_\zeta = r_s$ although the true $r_\zeta$ is less than $r_s$ to start. Now, $Q_s$ and $Q_g$ can be calculated according to equations (19) and (20). Because in reality $r_\zeta$ is less than $r_s$, there is more high viscosity fluid than assumed in front of the sampling tube. Thus, the sampling rate is higher than desired value because of the wrong starting guess for $r_\zeta$. The result is that there is likely to be cross-flow from the guard line into the sample line at formation interface, and the volume fraction of the formation fluids measured in the sampling line will be less than unity. Based on the determined volume fraction $z_{s1}$, the front location $r_\zeta$ can be computed from $$z_{s1} = \frac{1 - \frac{1}{r_p}\sqrt{r_p^2 - r_\zeta^2}}{\left(1 - \frac{1}{r_p}\sqrt{r_p^2 - r_\zeta^2}\right) + \frac{1}{r_p}\left(\sqrt{r_p^2 - r_\zeta^2} - \sqrt{r_p^2 - r_s^2}\right)\frac{\mu_1}{\mu_2}} \tag{21}$$

Based on the determined front location (which will be smaller than the correct value due to cross-flow), a new sampling line rate $Q_s$ (and guard line rate $Q_g$) can then be determined according to $$\frac{Q_s}{Q_p} = \frac{\left(1 - \frac{1}{r_p}\sqrt{r_p^2 - r_\zeta^2}\right) + \frac{1}{r_p}\left(\sqrt{r_p^2 - r_\zeta^2} - \sqrt{r_p^2 - r_s^2}\right)\frac{\mu_1}{\mu_2}}{\left(1 - \frac{1}{r_p}\sqrt{r_p^2 - r_\zeta^2}\right) + \frac{1}{r_p}\left(\sqrt{r_p^2 - r_\zeta^2}\right)\frac{\mu_1}{\mu_2}} \tag{22}$$

With the new sample line flow rate and with continued sampling, a new volume fraction of formation fluids $z_{s1}$ is calculated. Based on the new volume fraction, a new front location $r_\zeta$ can be calculated from equation (21). Likewise, from the new front location, a new sampling line rate can be determined from equation (22). Eventually, values for the sampling line flow rate $Q_s$ will converge. As time continues, the front location $r_\zeta$ will evolve, and the actual sample will be taken when the front location=$r_s$.

It will be appreciated by those skilled in the art that when the viscosity of the formation oil is greater than the viscosity of the OBM filtrate, the first iteration will give a value of $r_\zeta$ which is greater than the true value. Regardless, via iterative volume fraction determinations and processing, determinations of the sampling tube flow rate should converge over time.

Figure 4C:
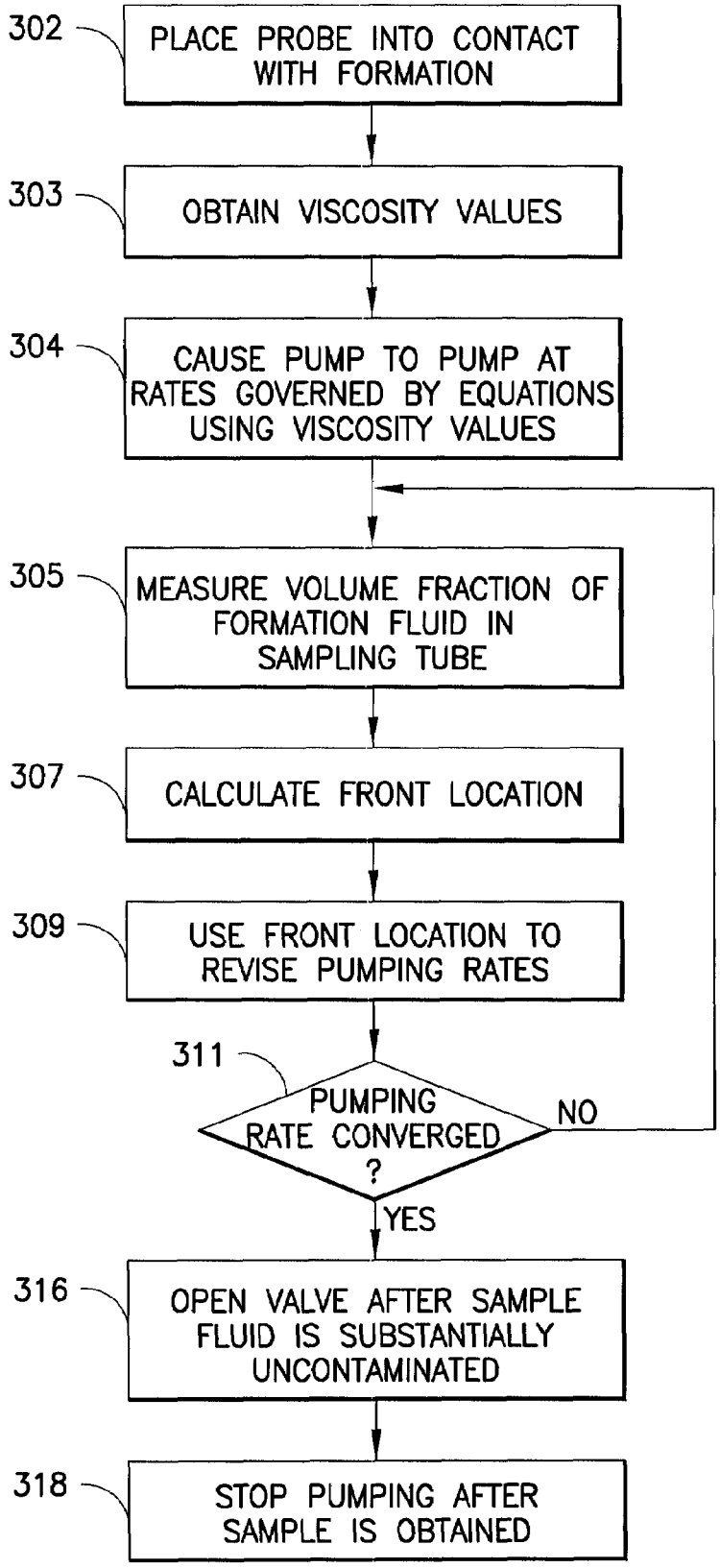

Turning now to FIG. 4*c*, an iterative method of the invention is seen. Thus, at 302, a probe having a sampling tube of a first known radius and a guard tube of a second known radius is placed into contact with the formation, with the sampling tube recessed slightly relative to the guard tube. At 303, the viscosities $\mu_s$ and $\mu_g$ are assumed, or measured or determined by the viscosity sensors 49*a*, 49*b*. At 304, based on the viscosity values, the pumps coupled to the sampling tube and the guard tube are caused to pump at rates governed by the equations $$\frac{Q_s}{Q_s + Q_g} = \frac{Q_s}{Q_p} = \frac{\left[1 - \frac{1}{r_p}\sqrt{r_p^2 - r_s^2}\right]}{\left[1 - \frac{1}{r_p}\sqrt{r_p^2 - r_s^2}\right] + \frac{\mu_s}{\mu_g}\frac{1}{r_p}\sqrt{r_p^2 - r_s^2}}$$

and $Q_g = Q_p - Q_s$. The total pumping rate $Q_p$ is chosen so that the probe pressure is above the bubble point, but preferably near the bubble point in order to establish a good flow. At 305, the volume fraction of the formation fluid in the sampling tube $z_{s1}$ is measured. At 307, based on $z_{s1}$, the front location $r_\zeta$ is calculated according to $$z_{s1} = \frac{1 - \frac{1}{r_p}\sqrt{r_p^2 - r_\zeta^2}}{\left(1 - \frac{1}{r_p}\sqrt{r_p^2 - r_\zeta^2}\right) + \frac{1}{r_p}\left(\sqrt{r_p^2 - r_\zeta^2} - \sqrt{r_p^2 - r_s^2}\right)\frac{\mu_1}{\mu_2}}.$$

Then, at 309, based on the calculated front location, a new sample line rate is calculated according to $$\frac{Q_s}{Q_p} = \frac{\left(1 - \frac{1}{r_p}\sqrt{r_p^2 - r_\zeta^2}\right) + \frac{1}{r_p}\left(\sqrt{r_p^2 - r_\zeta^2} - \sqrt{r_p^2 - r_s^2}\right)\frac{\mu_1}{\mu_2}}{\left(1 - \frac{1}{r_p}\sqrt{r_p^2 - r_\zeta^2}\right) + \frac{1}{r_p}\left(\sqrt{r_p^2 - r_\zeta^2}\right)\frac{\mu_1}{\mu_2}}$$

and the pumps coupled to the sampling and guard tubes are caused to pump accordingly. At 311 a determination is made as to whether a value for $Q_s$ (or an indication thereof such as, e.g., a ratio $Q_s/Q_p$, or $Q_g$) has converged. If not, steps 305, 307 and 309 are repeated iteratively until convergence is obtained. Then, after some time when it is determined through optical or other means that the flow in the sampling tube is substantially uncontaminated, a valve is opened at 316 which causes a sample from the sampling tube to go to a sampling chamber. When a desired sample is obtained, at 318 the pumping stops. The tool may then be moved to a new location, and steps 302-318 repeated to obtain another sample. This procedure may be repeated as many times as desired until all sample chambers are filled, or until it is desired to retrieve the samples.

Figure 4D:
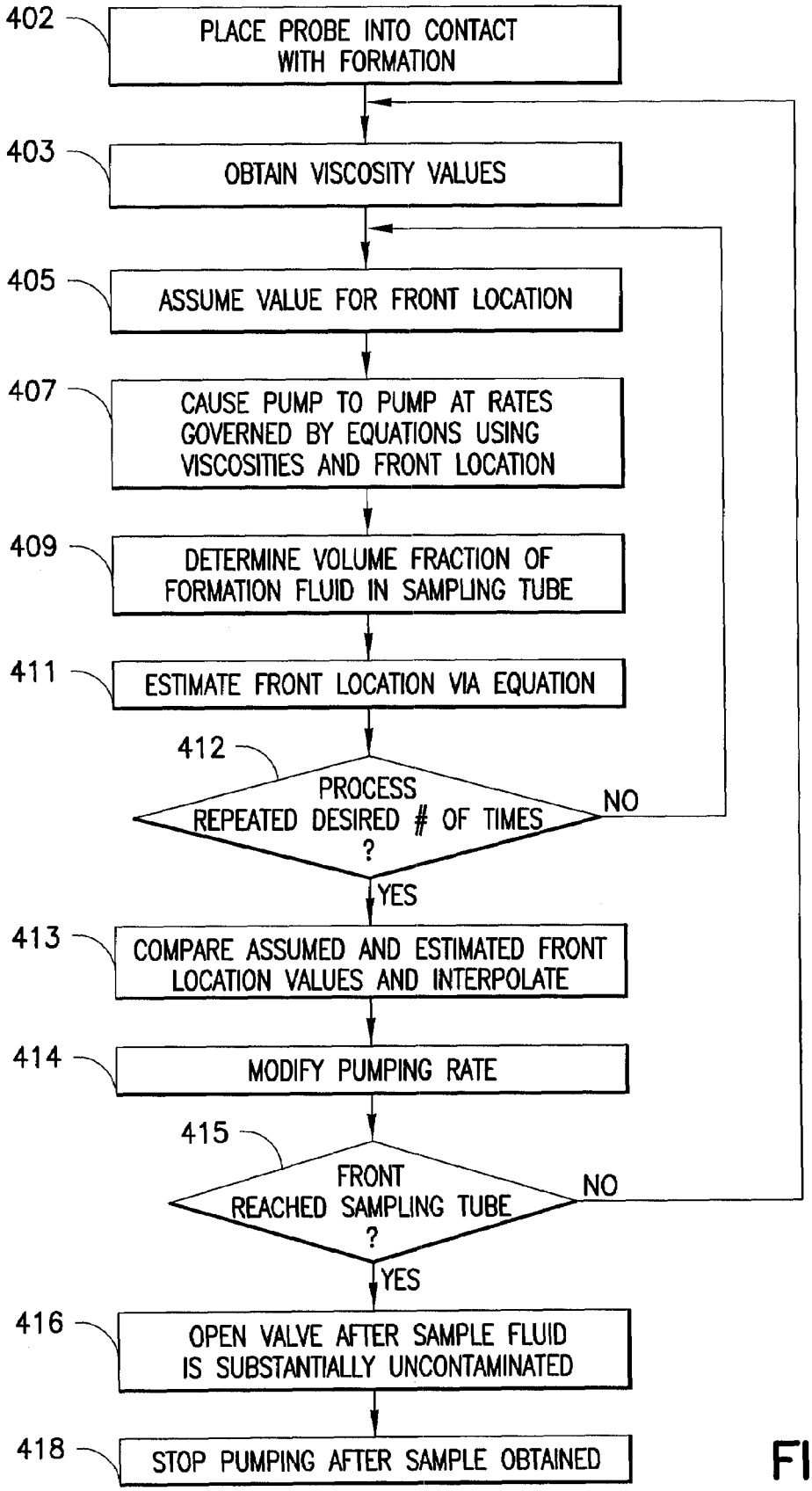

Turning now to FIG. 4*d*, and according to an alternative embodiment of the invention, at 402, a probe having a sampling tube of a first known radius and a guard tube of a second known radius is placed into contact with the formation, with the sampling tube recessed slightly relative to the guard tube. At 403, the viscosities $\mu_s$ and $\mu_g$ are assumed, or measured or determined by the viscosity sensors 49*a*, 49*b*. At 405, instead of assuming as a starting point that the front location is equal to the sampling tube radius, any reasonable first value of $r_\zeta$ may be assumed to start. Then, at 407, based on the measured or determined viscosities, the known radii, and the first assumed value of the front location, pumping rates are set according to equation (22). At 409, using the pumped samples, a determination of the volume fraction of the formation fluid $z_{s1}$ is made, and then at 411, an estimate of the front location $r_\zeta$ is calculated according to equation (21). At 412 a determination is made as to the number of times steps 405 through 411 have been repeated. If steps 405 through 411 have been repeated several times (e.g., at least three or four times), at 413 the guesses and the calculated values are compared, and an actual value for the front location is determined via interpolation. The front location is then used at 414 to modify the pumping rates according to equation (22). Based on the front location and the known radius of the sampling tube, or via optical or other methods, at 415 a determination is made as to whether the front (i.e., uncontaminated fluid) has reached the sampling tube. If not, steps 403-415 are preferably repeated until the front reaches the sampling tube. When it is determined that the front has reached the sampling tube such that the fluid flowing in the sample line is substantially uncontaminated, a valve is opened at 416 which causes a sample from the sampling tube to go to a sampling chamber. When a desired sample is obtained, at 418 the pumping stops. The tool may then be moved to a new location, and steps 402-418 repeated to obtain another sample. This procedure may be repeated as many times as desired until all sample chambers are filled, or until it is desired to retrieve the samples.

There have been described and illustrated herein an embodiment of a single probe formation tester and method of utilizing the tester to quickly obtain relatively uncontaminated formation fluids. While particular embodiments of the invention have been described, it is not intended that the invention be limited thereto, as it is intended that the invention be as broad in scope as the art will allow and that the specification be read likewise. Thus, while a particular tool arrangement has been disclosed, it will be appreciated that other arrangements could be used as well. For example, while the tool was disclosed as preferably including downhole processor equipment, it should be appreciated by those skilled in the art that the downhole sensors could send information uphole for processing, and control signals then sent downhole to control the pumps. In addition, while particular equations have been disclosed which govern determinations regarding pump rates, it will be understood that other equations can be used, particularly where other assumptions are utilized. In addition, instead of utilizing certain equations, look-up charts based on known information (e.g., the sampling tube radius and the probe radius) and, if desired, variables (e.g., certain viscosities) can be utilized, it being appreciated that the look-up charts will preferably be based on the equations. It will therefore be appreciated by those skilled in the art that yet other modifications could be made to the provided invention without deviating from its spirit and scope as claimed.

What is claimed is:

1. A formation tester tool for use in a borehole traversing a formation, comprising:

a) a probe having an inner tube of a first radius and having an inner tube first end, said probe having an outer tube extending about said inner tube and having an outer tube first end, said outer tube defining a second radius, said inner tube first end being slightly recessed relative to said outer tube first end;

b) means for causing said probe to contact a wall of the borehole;

c) at least one fluid sample chamber fluidly coupled to said inner tube;

d) pumps coupled to said inner tube and said outer tube; and e) a controller for controlling said pumps to establish flow rates through said inner tube and said outer tube based on a predetermined function of at least said first radius and said second radius.

2. A tool according to claim 1, wherein:

said predetermined function is $$\frac{Q_s}{Q_s+Q_g}=1-\frac{1}{r_p}\sqrt{r_p^2-r_s^2}$$

where $Q_s$ is a flow rate through said inner tube, $Q_g$ is a flow rate through said outer tube, $r_s$ is said first radius and $r_p$ is said second radius which is a radius of said probe.

3. A tool according to claim 1, wherein:

said controller establishes flow rates as a predetermined function of at least said first radius, said second radius, a first viscosity of fluid flowing through said first tube, and second viscosity of fluid flowing through said second tube.

4. A tool according to claim 3, wherein:

said function of at least said first radius, said second radius, a first viscosity of fluid flowing through said first tube, and second viscosity of fluid flowing through said second tube is $$\frac{Q_s}{Q_s+Q_g}=\frac{\left[1-\frac{1}{r_p}\sqrt{r_p^2-r_s^2}\right]}{\left[1-\frac{1}{r_p}\sqrt{r_p^2-r_s^2}\right]+\frac{\mu_s}{\mu_g}\frac{1}{r_p}\sqrt{r_p^2-r_s^2}}$$

where $Q_s$ is a flow rate through said inner tube, $Q_g$ is a flow rate through said outer tube, $r_s$ is said first radius, $r_p$ is said second radius, $\mu_s$ is said first viscosity and $\mu_g$ is said second viscosity.

5. A tool according to claim 3, wherein:

said predetermined function of at least said first radius, said second radius, a first viscosity of fluid flowing through said first tube, and second viscosity of fluid flowing through said second tube is $$\frac{Q_s}{Q_s+Q_g}=\frac{\left(1-\frac{1}{r_p}\sqrt{r_p^2-r_\varsigma^2}\right)+\frac{1}{r_p}\left(\sqrt{r_p^2-r_\varsigma^2}-\sqrt{r_p^2-r_s^2}\right)\frac{\mu_1}{\mu_2}}{\left(1-\frac{1}{r_p}\sqrt{r_p^2-r_\varsigma^2}\right)+\frac{1}{r_p}\left(\sqrt{r_p^2-r_\varsigma^2}\right)\frac{\mu_1}{\mu_2}}$$

where $Q_s$ is a flow rate through said inner tube, $Q_g$ is a flow rate through said outer tube, $r_s$ is said first radius, $r_p$ is said second radius, $\mu_1$ is said first viscosity, $\mu_2$ is said second viscosity, and $r_\varsigma$ is a location of a front between uncontaminated fluid from said formation and fluid from said formation contaminated by filtrate.

6. A tool according to claim 1, wherein:

said means for causing said probe to contact a wall is an extendable arm.

7. A tool according to claim 1, wherein:

at least one of said first tube and said second tube has a knife edge.

8. A tool according to claim 1, wherein:

said first end of said inner tube is recessed between 1 mm and 5 mm relative to said first end of said outer tube.

9. A tool according to claim 1, wherein:

said inner tube is coupled to said sample chamber by a hydraulic flow line, said hydraulic flow line including a valve.

10. A tool according to claim 3, further comprising:

first and second sensing means respectively coupled to said inner tube and to said outer tube and adapted for providing indications of said first viscosity and said second viscosity.

11. A tool according to claim 10, further comprising:

processing means for determining a volume fraction of formation fluids flowing through said inner tube.

12. A formation tester tool for use in a borehole traversing a formation, comprising:

a) a probe having an inner tube of a first radius and having an inner tube first end, said probe having an outer tube extending about said inner tube and having an outer tube first end, said outer tube defining a second radius, said inner tube first end being slightly recessed relative to said outer tube first end;

b) means for causing said probe to contact a wall of the borehole;

c) at least one fluid sample chamber fluidly coupled to said inner tube;

d) pumps coupled to said inner tube and said outer tube; and e) a controller for controlling said pumps to establish flow rates through said inner tube and said outer tube such that cross-flow is avoided between first fluids exiting the formation and entering said inner tube and second fluids exiting the formation and entering said outer tube.

13. A tool according to claim 12, wherein:

said controller utilizes information related to said first radius and said second radius in controlling said pumps to establish said flow rates.

14. A tool according to claim 13, wherein:

said controller further utilizes information related to a first viscosity of fluid flowing through said first tube, and second viscosity of fluid flowing through said second tube in controlling said pumps to establish said flow rates.

15. A tool according to claim 12, wherein:

said means for causing said probe to contact a wall is an extendable arm.

16. A tool according to claim 12, wherein:

at least one of said first tube and said second tube has a knife edge.

17. A tool according to claim 12, wherein:

said first end of said inner tube is recessed between 1 mm and 5 mm relative to said first end of said outer tube.

18. A tool according to claim 12, wherein:

said inner tube is coupled to said sample chamber by a hydraulic flow line, said hydraulic flow line including a valve.

19. A tool according to claim 14, further comprising:

first and second sensing means respectively coupled to said inner tube and to said outer tube and adapted for providing indications of said first viscosity and said second viscosity.

20. A tool according to claim 19, further comprising:

processing means for determining a volume fraction of formation fluids flowing through said inner tube.

21. A method of sampling fluids from a formation traversed by a borehole, comprising:

a) contacting a probe of a borehole tool against a wall of the borehole, the tool having at least one fluid sample chamber, pumps, a controller, and a probe, the probe having an inner tube of a first radius and having an inner tube first end, and having an outer tube extending about the inner tube and having an outer tube first end, the outer tube defining a second radius, the inner tube first end being slightly recessed relative to the outer tube first end, the at least one fluid sample chamber fluidly coupled to the inner tube, the pumps respectively coupled to the inner tube and the outer tube;

b) causing the controller to control the pumps to establish flow rates through the inner tube and the outer tube as a predetermined function of at least the first radius and the second radius.

22. A method according to claim 21, further comprising:

c) determining that fluid flowing through said inner tube is substantially uncontaminated; and d) operating a valve after said determining in order to cause substantially uncontaminated fluid to flow to the fluid sample chamber.

23. A method according to claim 22, wherein:

said predetermined function is $$\frac{Q_s}{Q_s + Q_g} = 1 - \frac{1}{r_p}\sqrt{r_p^2 - r_s^2}$$

where $Q_s$ is a flow rate through said inner tube, $Q_g$ is a flow rate through said outer tube, $r_s$ is said first radius and $r_p$ is said second radius which is a radius of said probe.

24. A method according to claim 22, further comprising:

e) obtaining indications of a first viscosity of fluid flowing through said inner tube, and second viscosity of fluid flowing through said outer tube, wherein said controller establishes flow rates as a predetermined function of at least said first radius, said second radius, said first viscosity, and said second viscosity.

25. A method according to claim 24, wherein:

said function of at least said first radius, said second radius, a first viscosity of fluid flowing through said inner tube, and second viscosity of fluid flowing through said outer tube is $$\frac{Q_s}{Q_s + Q_g} = \frac{\left[1 - \frac{1}{r_p}\sqrt{r_p^2 - r_s^2}\right]}{\left[1 - \frac{1}{r_p}\sqrt{r_p^2 - r_s^2}\right] + \frac{\mu_s}{\mu_g}\frac{1}{r_p}\sqrt{r_p^2 - r_s^2}}$$

where $Q_s$ is a flow rate through said inner tube, $Q_g$ is a flow rate through said outer tube, $r_s$ is said first radius, $r_p$ is said second radius, $\mu_s$ is said first viscosity and $\mu_g$ is said second viscosity.

26. A method according to claim 24, further comprising:

f) obtaining indications of at least one of an oil volume fraction and a filtrate volume fraction of the fluid flowing through said inner tube; and g) calculating a front location between formation fluid and filtrate fluid based on said first radius, said second radius, said first viscosity, said second viscosity, and at least one of said volume fractions; and h) utilizing said front location to modify said flow rates controlled by said pumps.

27. A method according to claim 26, further comprising:

repeating steps e) through h) more than once until a convergence of each of said flow rates is obtained.

28. A method according to claim 26, wherein:

said obtaining indications of a first viscosity of fluid flowing through said inner tube, and second viscosity of fluid flowing through said outer tube, comprises one of assuming, utilizing viscosity sensors to measure, and determining said first viscosity and said second viscosity.

29. A method according to claim 26, wherein:

said front location is calculated according to $$z_{s1} = \frac{1 - \frac{1}{r_p}\sqrt{r_p^2 - r_s^2}}{\left(1 - \frac{1}{r_p}\sqrt{r_p^2 - r_s^2}\right) + \frac{1}{r_p}\left(\sqrt{r_p^2 - r_s^2} - \sqrt{r_p^2 - r_s^2}\right)\frac{\mu_1}{\mu_2}}$$

where $Q_s$ is a flow rate through said inner tube, $Q_g$ is a flow rate through said outer tube, $r_s$ is said first radius, $r_p$ is said second radius, $r_\zeta$ is said front location, $z_{s1}$ is said oil volume fraction, $\mu_1$ is said first viscosity and $\mu_2$ is said second viscosity.

30. A method according to claim 29, wherein:

said utilizing comprises calculating new pump rates according to $$\frac{Q_s}{Q_p} = \frac{\left(1 - \frac{1}{r_p}\sqrt{r_p^2 - r_\zeta^2}\right) + \frac{1}{r_p}\left(\sqrt{r_p^2 - r_\zeta^2} - \sqrt{r_p^2 - r_s^2}\right)\frac{\mu_1}{\mu_2}}{\left(1 - \frac{1}{r_p}\sqrt{r_p^2 - r_\zeta^2}\right) + \frac{1}{r_p}\left(\sqrt{r_p^2 - r_\zeta^2}\right)\frac{\mu_1}{\mu_2}}$$

where $Q_p = Q_s + Q_g$.

31. A method according to claim 24, further comprising:

f) assuming a front location between formation fluid and filtrate fluid, wherein said predetermined function is a function of at least the first radius, the second radius, said first viscosity, said second viscosity, and said assumed front location.

32. A method according to claim 31, further comprising:

g) determining a volume fraction of formation fluid in said inner tube; and h) estimating a value for said front location according to $$z_{s1} = \frac{1 - \frac{1}{r_p}\sqrt{r_p^2 - r_\zeta^2}}{\left(1 - \frac{1}{r_p}\sqrt{r_p^2 - r_\zeta^2}\right) + \frac{1}{r_p}\left(\sqrt{r_p^2 - r_\zeta^2} - \sqrt{r_p^2 - r_s^2}\right)\frac{\mu_1}{\mu_2}}$$

where $Q_s$ is a flow rate through said inner tube, $Q_g$ is a flow rate through said outer tube, $r_s$ is said first radius, $r_p$ is said second radius ,$r_\zeta$ is said front location, $z_{s1}$ said oil volume fraction, $\mu_1$ is said first viscosity and $\mu_2$ is said second viscosity.

33. A method according to claim 32, further comprising:

i) repeating steps f) through h) a plurality of times;

j) comparing said values estimated at step h) with values of said front location assumed at step f) in order to make a front location determination; and k) using said front location determination to modify said flow rates controlled by said pumps.

34. A method according to claim 33, further comprising:

l) repeating steps f) through k) at least until determining that said front location has reached said inner tube.

35. A method according to claim 33, wherein:

said flow rates are modified using $$\frac{Q_s}{Q_p} = \frac{\left(1 - \frac{1}{r_p}\sqrt{r_p^2 - r_\zeta^2}\right) + \frac{1}{r_p}\left(\sqrt{r_p^2 - r_\zeta^2} - \sqrt{r_p^2 - r_s^2}\right)\frac{\mu_1}{\mu_2}}{\left(1 - \frac{1}{r_p}\sqrt{r_p^2 - r_\zeta^2}\right) + \frac{1}{r_p}\left(\sqrt{r_p^2 - r_\zeta^2}\right)\frac{\mu_1}{\mu_2}}.$$

36. A method of sampling fluids from a formation traversed by a borehole, comprising:

a) contacting a probe of a borehole tool against a wall of the borehole, the tool having at least one fluid sample chamber, pumps, a controller, and a probe, the probe having an inner tube of a first radius and having an inner tube first end, and having an outer tube extending about the inner tube and having an outer tube first end, the outer tube defining a second radius, the inner tube first end being slightly recessed relative to the outer tube first end, the at least one fluid sample chamber fluidly coupled to the inner tube, the pumps respectively coupled to the inner tube and the outer tube;

b) causing the controller to control the pumps to establish flow rates through the inner tube and the outer tube such that cross-flow is avoided between first fluids exiting the formation and entering said inner tube and second fluids exiting the formation and entering said outer tube.

37. A method according to claim 36, further comprising:

c) determining that fluid flowing through said inner tube is substantially uncontaminated; and d) operating a valve after said determining in order to cause substantially uncontaminated fluid to flow to the fluid sample chamber.

38. A method according to claim 36, wherein:

said controller utilizes information related to said first radius and said second radius in controlling said pumps to establish said flow rates.

* * * * *